United States Patent [19]

Petryshyn

[11] Patent Number: 4,821,932

[45] Date of Patent: Apr. 18, 1989

[54] HOLDER FOR SHOE POLISH CANS

[76] Inventor: Jon E. Petryshyn, 512 Sixth Ave. West, Lyndon, Ill. 61261

[21] Appl. No.: 182,640

[22] Filed: Apr. 18, 1988

[51] Int. Cl.[4] ..... A45C 13/30

[52] U.S. Cl. ..... 224/222; 224/247; 15/259

[58] Field of Search ..... 224/219, 222, 242, 247, 224/267; 229/1.5 H; 220/96; 248/346.1, 172, 146; 401/6, 7, 8; 15/258, 259

[56] References Cited

U.S. PATENT DOCUMENTS

| | | | |
|---|---|---|---|
| 145,544 | 12/1873 | Wyman | 15/259 |
| 466,895 | 1/1892 | Perkins | 15/259 |
| 1,079,993 | 12/1913 | Ramsey | 15/259 |
| 1,363,901 | 12/1920 | Moyle | 15/259 |
| 1,559,210 | 10/1925 | Wetherell | 224/222 |
| 1,611,672 | 12/1926 | Platt | 15/259 |
| 2,364,814 | 12/1944 | Plummer et al. | 224/222 |
| 2,701,173 | 2/1955 | Senior et al. | 224/267 |
| 3,357,669 | 12/1967 | D'Amato | 248/346.1 |
| 4,401,233 | 8/1983 | Frey | 224/219 |

FOREIGN PATENT DOCUMENTS

| | | | |
|---|---|---|---|
| 462300 | 3/1937 | United Kingdom | 224/222 |

*Primary Examiner*—Henry J. Recla
*Assistant Examiner*—Linda J. Sholl
*Attorney, Agent, or Firm*—Henderson & Sturm

[57] ABSTRACT

A holder in the form of an upwardly facing cup dimensioned to tightly receive and carry the lower half of a conventional shoe polish can. The holder is equipped with a strap or the like to attach the holder to the using person's thigh so as to leave both of the user's hands free to attend to the polishing of his shoes. The rim of the cup that receives the lower half of the can is notched to accommodate the opener key on the can. In a modified form of the holder, back-to-back cups share a common bottom and the cups are of different diameters for accepting cans of different dimensions.

2 Claims, 1 Drawing Sheet

Fig. 1
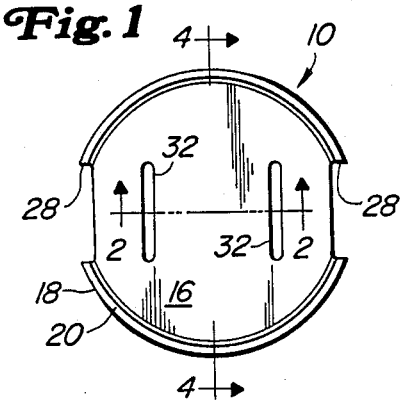
Fig. 2
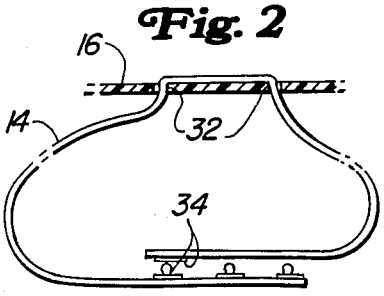
Fig. 3
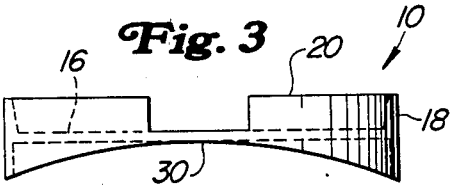
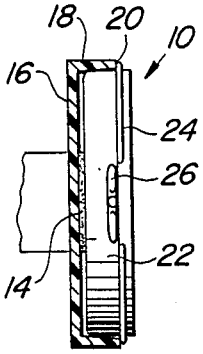
Fig. 4
Fig. 6
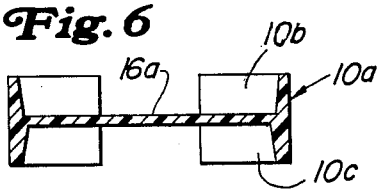
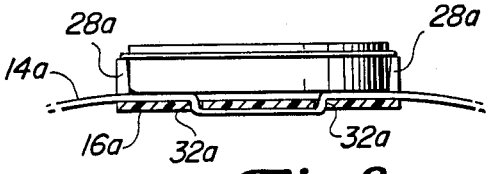
Fig. 8
Fig. 5
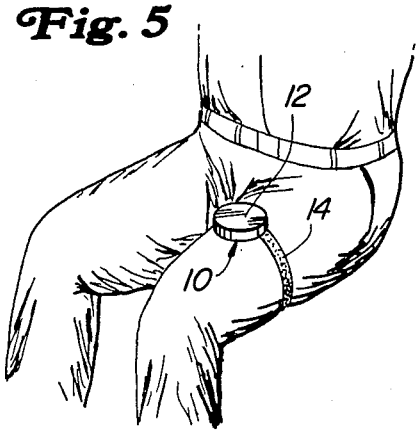
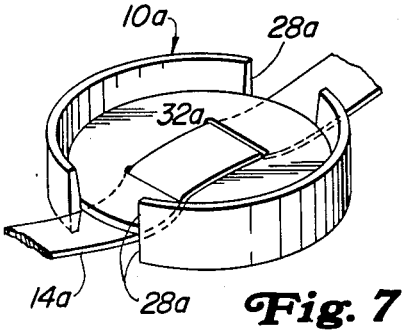
Fig. 7

HOLDER FOR SHOE POLISH CANS

BACKGROUND AND SUMMARY OF THE INVENTION

The task of polishing one's own shoes is made difficult because holding the shoe polish can in one hand leaves only the other hand free, a situation that is even more difficult when the shoes are being polished while removed from the feet and held by hand. Further, the size and shape of the conventional can presents further problems because the can is hard to grasp. According to the present invention, the polish can is carried by a holder which is attached to the user's thigh, for example, thus leaving both hands free, one hand to hold the shoe and the other to apply the polish, use the brush, etc. It is a feature of the invention that the holder is in the form of a simple cup-like member that tightly receives the lower half of the shoe polish can. Further, the rim of the cup is notched so as to accommodate the opener key typically provided on most cans. In a modified form of the invention, the holder is a pair of back-to-back cups sharing a common bottom or partition, and the cups are of different diameters so as to accommodate cans of different diameters.

Further features and advantages of the invention will become apparent as the disclosure progresses herein.

DESCRIPTION OF THE DRAWINGS

FIG. 1 is a plan view of one form of the invention.

FIG. 2 is a fragmentary section on the line 2—2 of FIG. 1.

FIG. 3 is an elevation of the holder.

FIG. 4 is a section on the line 4—4 of FIG. 1.

FIG. 5 is a schematic view showing the holder in use.

FIG. 6 is a section through the modified double-cup holder.

FIG. 7 is a perspective of the double-cup holder, showing how the attaching strap is applied.

FIG. 8 is a section showing the strap arrangement in the modified holder.

DETAILED DESCRIPTION OF PREFERRED EMBODIMENTS OF THE INVENTION

Reference is had first to FIG. 5 for an over-view of the invention and its use, wherein the numeral (10) designates the holder cup as mounting the lower half (12) of a typical shoe polish can. The holder includes stra or band means (14) for attachment to the user's thigh, for example, so that the shoe polish can is relatively fixed as to position while exposing its contents upwardly. Thus the user's two hands are free.

The cup (10) has a flat bottom (16) from which rises a peripheral wall (18) to a uniform height terminating in a substantially circular rim (20). The diameter of the wall is based on the o.d. of a selected conventional shoe polish can as at (12) in FIG. 5, the bottom half of such can being numbered (22) in FIG. 4 and typically including an annular flange (24) and an opener key (26). The cup wall is notched at (28) at diametrically opposed portions to accommodate the key (26). The can half has a friction fit in the cavity formed by the wall. The holder is preferably made of injection-molded plastic and is relatively rigid, and the wall (18), of course, is integral with the bottom (16). In a situation in which the holder is intended for use with a can of the type marketed under the name and style of Kiwi, for example, the interior diameters of the wall (18) will be 2.733" at the top and 2.696" at the bottom, providing a suitable taper to achieve a frictional fit with the lower half of the can. Holders will vary according to can sizes, an example of which will appear later herein. As seen in FIG. 3 under portions of the bottom (16) may be curved on a relatively large radius to provide a curved surface (30) adapted to rest on the user's thigh.

FIG. 2 shows how the strap may be reeved through a pair of slots (32) in the cup bottom (16) so that opposite ends of the strap extend below and oppositely laterally. The strap is of course long enough to embrace thighs, etc., of various sizes and may be elastic and equipped with a plurality of snaps or the like as at (34) for adjustment. As noted in FIG. 4, the can bottom annular flange (24) seats on the cup rim (20) and the can does not bind against the strap that spans the two slots (30). As already seen, one of the wall notches (28) accommodates the opener key (26).

The foregoing dimensions as related to a specific shoe polish can are not intended to limit the scope and use of the invention, since the cup may be manufactured in many sizes to receive so-called jumbo cans, for example. As an extension of the versatility of the invention, reference is had to FIGS. 6, 7 and 8 wherein a modified form of holder **(10*a*) is shown as having back-to-back cups (10*b*) and (10*c*) sharing a common bottom (16*a*). Each cup may be a substantial duplicate of that of FIGS. 1–5 except for diameters. For example, the cup (10b) may be identical to the cup of FIGS. 1–5 and thus receptive of a Kiwi can, whereas the cup (10c)** may have different diameters for accommodating that brand of polish sold under the name and style of Esquire. The diameters involved for Esquire are 2.750" at the top of the rim and 2.742" at the bottom, producing the requisite a taper. In cases where other cans are to be accommodated, the holder or holders will of course be designed and dimensioned accordingly.

FIG. 7 and 8 illustrate how the strap **(14*a*) is reeved through slots (32*a*) in the common bottom (16*a*) and uses the wall notches (28*a*) so that the strap need not be removed and re-threaded when different size cans are used. For example, if a can is used in the top cup (10*a*), the situation is as explained with regard to FIG. 2. If the holder is inverted and a can is used in the other cup (10*b*) (now the top cup), the ends of the strap will exit oppositely through appropriate notches (28*a*) and the thickness of the strap will not interfere with proper seating of the can in the cup. This may be best understood by comparing FIG. 7 as shown with a reversed position as seen in FIG. 8**. That is to say, whichever cup is used to hold a can, the strap presents no impediment to proper reception and retention of the can.

The forms of the invention may be easily and inexpensively manufactured and distributed and will readily demonstrate their utility to the users. Features and advantages of the invention other than those specifically pointed out herein readily occur to those versed in the art, as will changes in the structure, all without departure of the spirit and scope of the invention.

I claim:

1. A user-supported holder for a can of shoe polish of the type having upper and lower halves separable by an opener key on the lower half, comprising a first cup formed of relatively rigid material and having a circular bottom and a first peripheral wall rigid with and rising from the bottom to a uniform height and terminating in a top rim to define, with the bottom, a first circular cavity dimensioned to relatively tightly receive the lower half of the can of shoe polish, the wall being of such height that the can projects above the rim, a portion of the wall and rim being interrupted to afford a notch for accommodating the opener key of the lower half of the can, a second peripheral wall rigid with and depending from the bottom and providing a second cup substantially duplicative of the first-mentioned cup but of a different diameter for receiving the lower half of a different-sized shoe polish can, the second wall likewise having notch for accommodating the opener-key of the second-mentioned can, and means connected to the holder for attaching the holder to a limb of the user.

2. A holder according to claim 1, in which the bottom has a pair of through-slots and each peripheral wall has a pair of key-accommodating notches diametrically alined with each other and with the slots and the attaching means includes a flexible member passing through the slots and accommodated by the notches of the downwardly facing wall.

* * * * *